US008408134B2

(12) United States Patent
Sibum

(10) Patent No.: US 8,408,134 B2
(45) Date of Patent: Apr. 2, 2013

(54) HAND GRENADE FUSE

(75) Inventor: Klaus Sibum, Nonnweiler (DE)

(73) Assignee: Diehl BGT Defence GmbH & Co., KG, Ueberlingen (DE)

( * ) Notice: Subject to any disclaimer, the term of this patent is extended or adjusted under 35 U.S.C. 154(b) by 0 days.

(21) Appl. No.: 13/527,168

(22) Filed: Jun. 19, 2012

(65) Prior Publication Data

US 2012/0272852 A1 Nov. 1, 2012

Related U.S. Application Data

(63) Continuation of application No. PCT/EP2010/007272, filed on Dec. 1, 2010.

(30) Foreign Application Priority Data

Dec. 22, 2009 (DE) ..... 10 2009 059 951

(51) Int. Cl.
*F42C 15/34* (2006.01)

(52) U.S. Cl. ..... 102/255; 102/487; 102/488; 102/272; 102/277.1

(58) Field of Classification Search ..... 102/222, 102/254, 255, 256, 257, 482, 487, 488, 272, 102/274, 276, 277.1
See application file for complete search history.

(56) References Cited

U.S. PATENT DOCUMENTS

| | | | | |
|---|---|---|---|---|
| 3,618,522 | A * | 11/1971 | Henderson | 102/222 |
| 3,683,814 | A | 8/1972 | Bedall et al. | |
| 3,945,323 | A * | 3/1976 | Boswell | 102/222 |
| 4,078,496 | A | 3/1978 | Kruger et al. | |
| 4,730,559 | A * | 3/1988 | Brightman | 102/254 |
| 5,635,667 | A | 6/1997 | Boyer et al. | |
| 6,082,267 | A | 7/2000 | Cooper | |
| 6,578,489 | B2 | 6/2003 | Boyer et al. | |

FOREIGN PATENT DOCUMENTS

| | | |
|---|---|---|
| DE | 2 010 881 | 9/1971 |
| FR | 2 465 189 A1 | 3/1981 |
| FR | 2 682 471 A1 | 4/1993 |

OTHER PUBLICATIONS

International Search Report of PCT/EP2010/007272.

* cited by examiner

*Primary Examiner* — James Bergin
(74) *Attorney, Agent, or Firm* — Laurence A. Greenberg; Werner H. Stemer; Ralph E. Locher

(57) ABSTRACT

A hand grenade fuze has a firing cap, a delay charge, which can be fired by the firing cap, in a delay charge holder, a detonator, which can be fired by the delay charge, in a detonator holder, and a booster charge, which can be fired by the detonator, for firing a hand grenade explosive charge.

13 Claims, 5 Drawing Sheets

HAND GRENADE FUSE

CROSS-REFERENCE TO RELATED APPLICATION

This is a continuation application, under 35 U.S.C. §120, of copending international application No. PCT/EP2010/007272, filed Dec. 1, 2010, which designated the United States; this application also claims the priority, under 35 U.S.C. §119, of German patent application No. DE 10 2009 059 951.7, filed Dec. 22, 2009; the prior applications are herewith incorporated by reference in their entirety.

BACKGROUND OF THE INVENTION

Field of the Invention

The invention relates to a hand grenade fuze having a firing cap, a delay charge, which can be fired by the firing cap, in a delay charge holder, a detonator, which can be fired by the delay charge, in a detonator holder, and a booster charge, which can be fired by the detonator, for firing a hand grenade explosive charge.

Hand grenade fuzes such as these are known from the prior art. In this case, firing of the firing cap results in the delay charge being fired. The detonator holder is fixed on the delay charge by a soldered connection. During the burning of the delay charge, the soldered connection is released, and the detonator holder is moved by the force of a stressed spiral spring such that the detonator, which is contained in the detonator holder, is positioned in an insert. When the detonator is fired by a flame jet originating from the burning delay charge, the detonation of the detonator results in the insert being knocked through, and the booster charge which is covered by the insert being fired.

A certain level of safety is ensured for the hand grenade fuze in that detonation of the detonator when the detonator holder is in the position secured by the soldered connection does not result in the insert being knocked through, and therefore does not result in the booster charge being fired. However, the hand grenade fuze has the disadvantage that firing of the firing cap, even when this is not intended, for example as a result of the influence of heat, produced in an open flame, always leads to the booster charge being fired, and therefore to the hand grenade explosive charge being fired.

In the case of grenades which have been fired by a launching apparatus, it is normal practice to provide a safety element to enhance safety, which safety element is made inoperable only by a defined force, which occurs during launching, for example a rotational force. A force defined in this way is, however, not available for use of a hand grenade. Electronic safety elements which are also known from the prior art for hand grenades are expensive to manufacture. Furthermore, their long-term reliability is questionable.

SUMMARY OF THE INVENTION

The object of the present invention is to provide a cost-effective hand grenade fuze which offers better safety against inadvertent activation than the mechanical hand grenade fuzes described above. One particular aim is for inadvertent firing of the firing cap not to automatically lead to firing of the booster charge. The firing cap is fired inadvertently, for example, in the event of a so-called "fast cook off", in which the hand grenade is subjected to an open fire. A further aim is to provide a hand grenade having a fuze such as this.

According to the invention, a hand grenade fuze is provided having a firing cap, a delay charge, which can be fired by the firing cap, in a delay charge holder, a detonator, which can be fired by the delay charge, in a detonator holder, and a booster charge, which can be fired by the detonator, for firing a hand grenade explosive charge. The detonator holder is in this case configured such that it can pivot. The delay charge holder, which is arranged in a first position, blocks a pivoting movement of the detonator holder in a rest position. In the rest position, the detonator is not arranged in line with the booster charge and the delay charge, such that burning of the delay charge cannot fire the detonator, and detonation of the detonator cannot fire the booster charge. The delay charge holder is held in the first position by a connection which can be released by heat. The connection which can be released by heat may, for example, be a plastics connection, although it may also be wax or an adhesive connection. A combination of plastics, wax and/or adhesive is also possible. The connection which can be released by heat is arranged such that burning of the delay charge results in the connection which can be released by heat being released and, under the influence of a force action, for example from at least one stressed spring, results in the delay charge holder assuming a second position, with the blocking of the pivoting movement of the detonator holder being cancelled, thus resulting in the detonator holder being pivoted from the rest position to an activation position. The force action can also be produced by a pressure, in particular a gas pressure, instead of by means of the at least one stressed spring. As a result of this, the detonator is arranged in line with the booster charge and the delay charge such that the detonator is fired by the burning of the delay charge, and the detonation of the detonator which results from this fires the booster charge. By way of example, once the blocking has been cancelled, the detonator holder can be pivoted by the force of a stressed spring.

Since there is no need to provide any safety separation between the detonator and an insert that has to be overcome by the detonation of the detonator for the hand grenade fuze according to the invention, the fuze according to the invention can be considerably shorter than a conventional hand grenade fuze with the same cross section. Furthermore, the fuze according to the invention can be produced with less weight, fewer components and at lower cost than a conventional hand grenade fuze.

However, the major advantage of the hand grenade fuze according to the invention is that inadvertent firing of the firing cap does not necessarily lead to the complete sequence of the firing chain by burning of the delay charge, detonation of the detonator and firing of the booster charge. For this purpose, all that need be ensured is that the delay charge holder is secured in the first position such that, when the delay charge burns, possibly even only temporary release of the connection which can be released by heat, as a result of the heat released during burning, does not lead to the delay charge holder being able to assume the second position. The blocking of the pivoting movement of the detonator holder is thus maintained, and the burning delay charge cannot fire the detonator. The firing chain is thus interrupted. The hand grenade fuze according to the invention is therefore considerably safer than conventional hand grenade fuzes.

In one refinement of the invention, the delay charge holder is held together with a slide, which is also provided, in the first position by the connection which can be released by heat. In this case the slide is arranged such that the release of the connection which can be released by heat results, under the influence of the force action, for example of a stressed spring, in the slide assuming a third position, wherein, as a result of the third position being assumed, the slide causes the detonator holder to pivot from the rest position to the activation position. This configuration means that there is no need for a further spring for pivoting the detonator holder. The design of the hand grenade fuze is thus further simplified. It can thus be produced even more advantageously.

The detonator holder may be essentially spherical. This allows the detonator holder to be mounted in a particularly simple manner, cost-effectively, reliably, and such that it can pivot. "Essentially" in this case means that relatively minor deviations from the spherical shape are possible, which are used, for example, for engagement of the slide or for blocking of the pivoting movement.

In a further refinement according to the invention, the detonator holder has an opening, particularly in the form of a channel, through which the detonator can be fired by the burning delay charge. The provision of the opening makes it possible to further improve the safety of the hand grenade fuze according to the invention, because a flame jet, or a firing jet, originating from the delay charge, must impact precisely on the opening in order to fire the detonator.

In the hand grenade fuze according to the invention, a supporting disc, which has an aperture, can be arranged on the delay charge holder between the detonator holder and the delay charge holder. In this case, the detonator holder has a flat on which the supporting disc is held by the delay charge holder, in order to block the pivoting movement. The provision of the supporting disc means that a relatively large area of the detonator holder is blocked in order to prevent the pivoting movement. This measure further improves the safety of the hand grenade fuze according to the invention. The aperture in the supporting disc is necessary in order that a flame jet which originates from the burning delay charge can reach and fire the detonator through the aperture.

The connection which can be released by heat may be a soldered connection. This can be produced reliably and relatively cost-effectively.

In one refinement of the hand grenade fuze according to the invention, a hammer is also provided in order to strike the firing cap, and a secured grip is provided in order to hold the hammer in an initial position. In this case, the delay charge holder is secured in the first position by the grip or a safety element which is held by the grip, wherein the grip and, if present, the safety element are/is designed such that removing the safety element and releasing the grip result in the safety of the delay charge holder being cancelled. This refinement reliably prevents the hand grenade from being fired inadvertently when the grip is secured. Even firing of the firing cap and of the delay charge does not result in the detonator and the booster charge being fired, because the delay charge holder cannot leave the first position, even if the connection which can be released by heat is released by the burning of the delay charge. However, when the hand grenade is correctly armed and thrown, and the grip is thus released, the delay charge holder can assume the second position, and can result in a serviceable firing chain being produced.

The hammer can be mounted such that it can pivot. Furthermore, a stressed torsion spring can be provided which, when the safety element is removed and the grip is released, results in the hammer striking the firing cap in a pivoting movement, and firing it.

The grip and, if present, the safety element and/or the hand grenade fuze can be configured such that removing the safety element and releasing the grip result in the grip and, if present, the safety element being released from the hand grenade fuze. A refinement such as this can be provided without any problems by a person skilled in the art. For example, the grip may be a mount in the form of a half shell, which is pressed against an opposing bearing by a spring. When there is no spring force because of the grip having changed position when the hand grenade is thrown, a grip such as this would cease to be held on the opposing bearing, and would be released from the hand grenade fuze.

The invention also relates to a hand grenade having a hand grenade fuze according to the invention.

Other features which are considered as characteristic for the invention are set forth in the appended claims.

Although the invention is illustrated and described herein as embodied in a hand grenade fuse, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
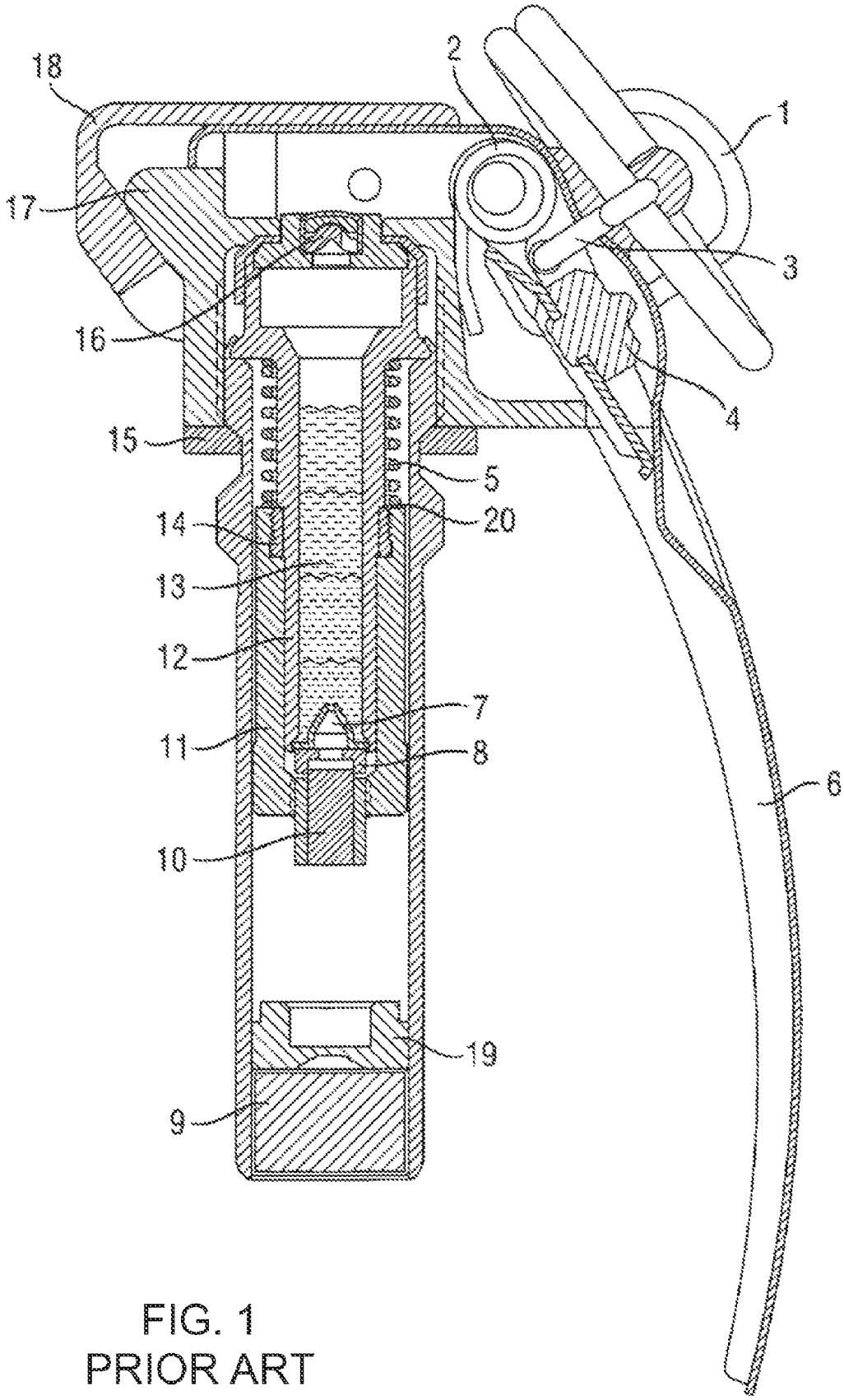
FIG. 1 PRIOR ART
FIG. 1 is a diagrammatic, perspective view of a hand grenade fuze according to the prior art.

Referring now to the figures of the drawing in detail and first, particularly, to FIG. 1 thereof, there is shown a hand grenade fuze according to the prior art. The removal of an optional safety clip 1 and of the safety pin with a ring 3 first of all results in a protective shroud 18 no longer being held, as a result of which the protective shroud 18 falls off. Once a grip 6 is released, a hammer 4, which is arranged such that it can pivot, is moved over by the force of the prestressed torsion spring 2. During the process, the grip 6 is released. The hammer 4 strikes the firing cap 16 and thus fires it.

The fired firing cap 16 initiates a delay charge 13, which burns away within about 3.5 seconds, starting from the firing cap 16. As soon as the fire front in the delay charge reaches a solder point 20, the heat created by it unsolders a threaded ring 14. The force of a stressed helical spring 5 then pushes a detonator holder 11 as far as the stop which is formed by an insert 19, while the delay charge holder 12 remains in the same position. A flap valve 8 is thus released, which is held closed until then by a detonator 10. When the fire front reaches a constriction pan 7, which is arranged at the lower end of the delay charge holders and has two apertures, the constriction pan produces a firing jet, in the direction of the detonator, pushing a flap valve 8 open. The firing jet bridges the gap to the detonator 10, and fires the detonator. When the detonator is fired, it strikes through an insert 19 and thus fires a booster charge 9, which then in turn fires a hand grenade explosive charge, which is not illustrated here.

Figure 2:
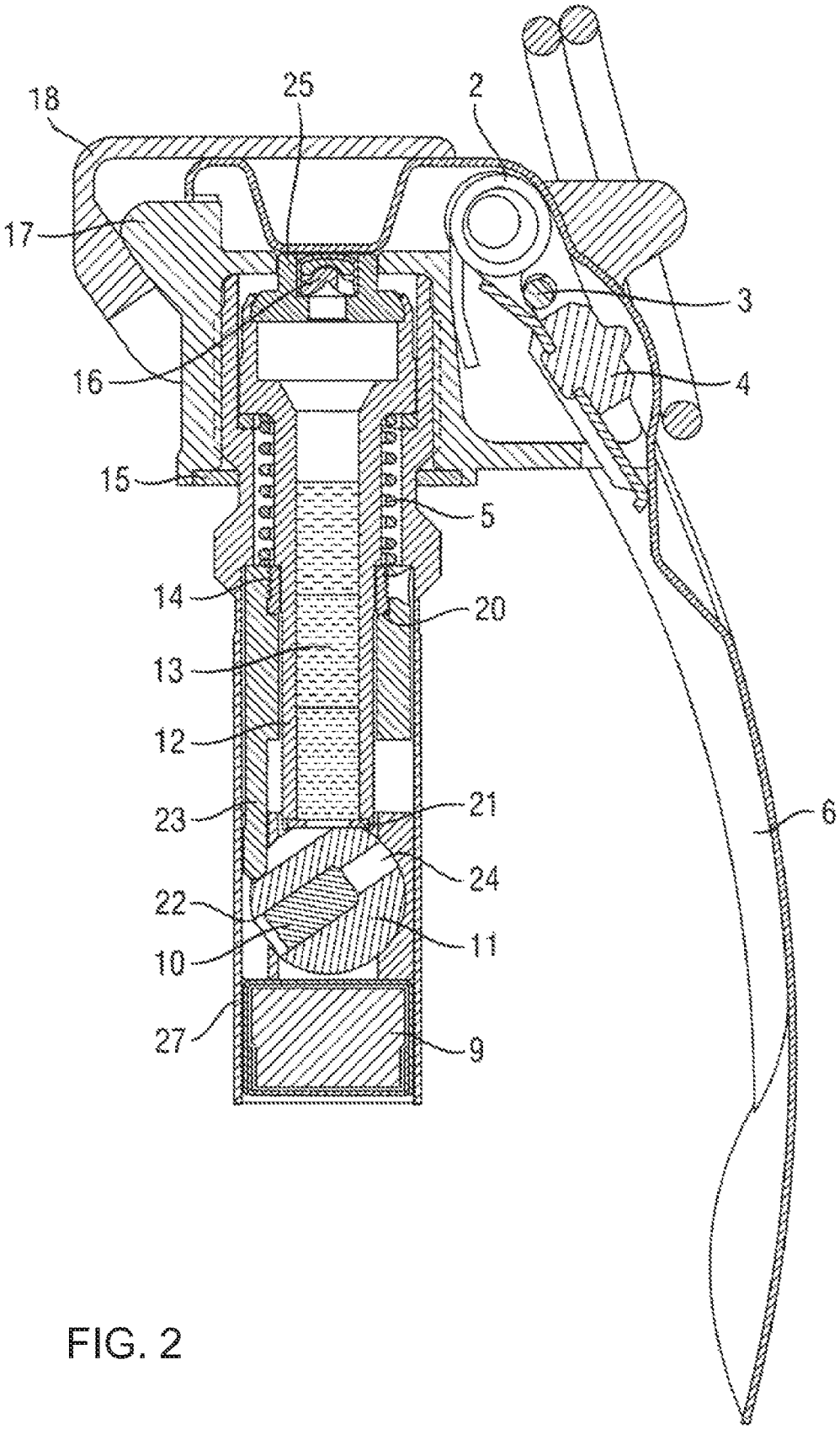
FIG. 2 is a diagrammatic, perspective view of a hand grenade fuze according to the invention with a grip.

The fuze also leads to detonation of the hand grenade when the firing cap 16 is fired inadvertently, for example by the entire hand grenade being severely heated. The hand grenade fuze according to the invention, as shown in FIG. 2, Prevents this. The reference signs in FIG. 2 have the same meaning as the corresponding reference signs in FIG. 1.

A supporting disc 21, which is arranged on the delay charge holder 12, is knocked through and is held by the delay charge holder 12 on a flat on the spherical detonator holder 11, prevents the detonator holder 11 from being able to carry out a pivoting movement. Furthermore, a slide 23, a channel 24 in the detonator holder 11 and a fuze holder 25 which is a component of the grip 6 are provided. The safety clip 1 illustrated in FIG. 1 is not shown in FIG. 2. However, it is possible to provide a safety clip 1 in this design also. The hand grenade fuze according to the invention operates correctly as now described.

Figure 3:
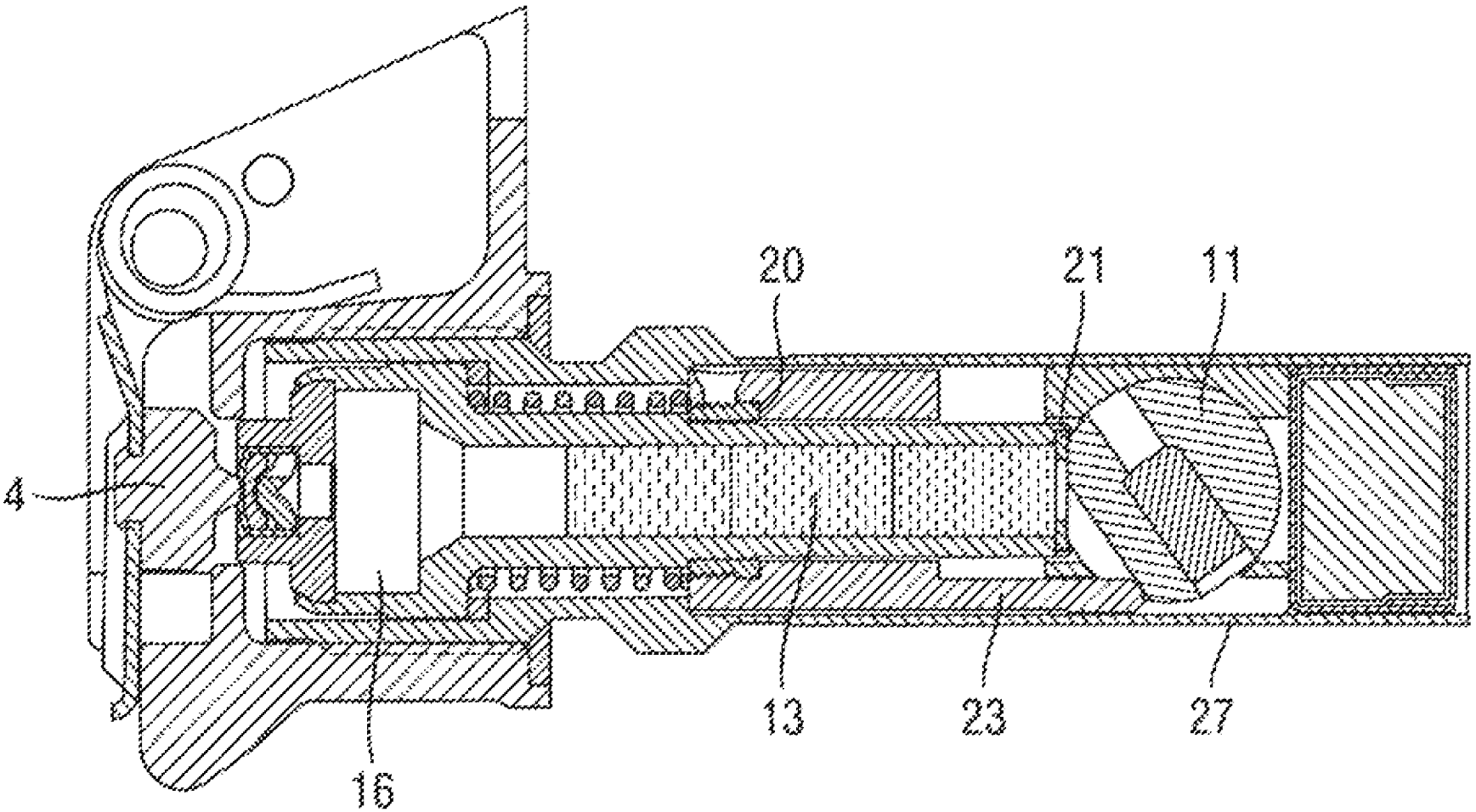
FIG. 3 is a diagrammatic, perspective view of the hand grenade fuze according to the invention when a hammer strikes a firing cap.

After the safety pin with the ring 3 has been removed, the protective shroud 18 falls away. Once the grip 6 is released, the change in the position of the hammer 4 which is produced by the torsion spring 2 causes the grip 6 with the fuze holder 25 to be forced away. The hammer 4 strikes the firing cap 16 and results in it being fired, as a result of which the delay charge 13 is initiated. This burns away starting from the firing cap. FIG. 3 illustrates the situation shortly before the fire front in the delay charge 13 reaches the solder point 20.

Figure 4:
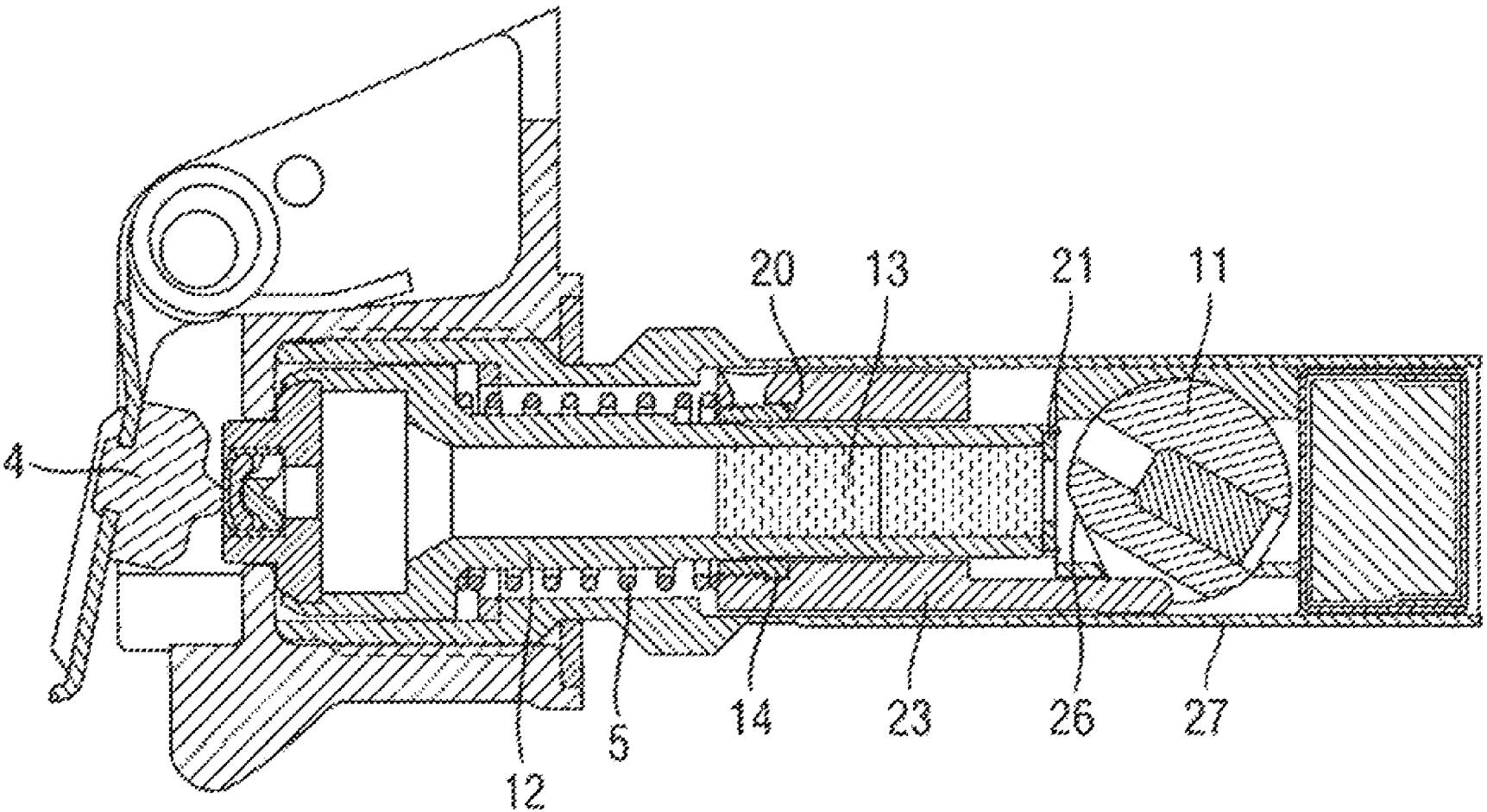
FIG. 4 is a diagrammatic, perspective view of the hand grenade fuze according to the invention during burning of a delay charge, immediately after a connection which can be released by heat has been released.

FIG. 4 shows the situation after the fire front of the delay charge 13 has passed the solder point 20 and has caused the threaded ring 14 to be unsoldered. In consequence, the stressed helical spring 5 moves the entire delay charge holder 12 in the direction of the hammer 4. A gap is therefore opened between the supporting disc 21 and the detonator holder 11, cancelling the blocking of a pivoting movement of the detonator holder 11 by the supporting disc 21 being held on the flat 26 on the detonator holder 11. The slide 23 is also moved in the direction of the detonator holder 11 by the force of the stressed helical spring 5, thus resulting in a pivoting movement of the detonator holder 11.

Figure 5:
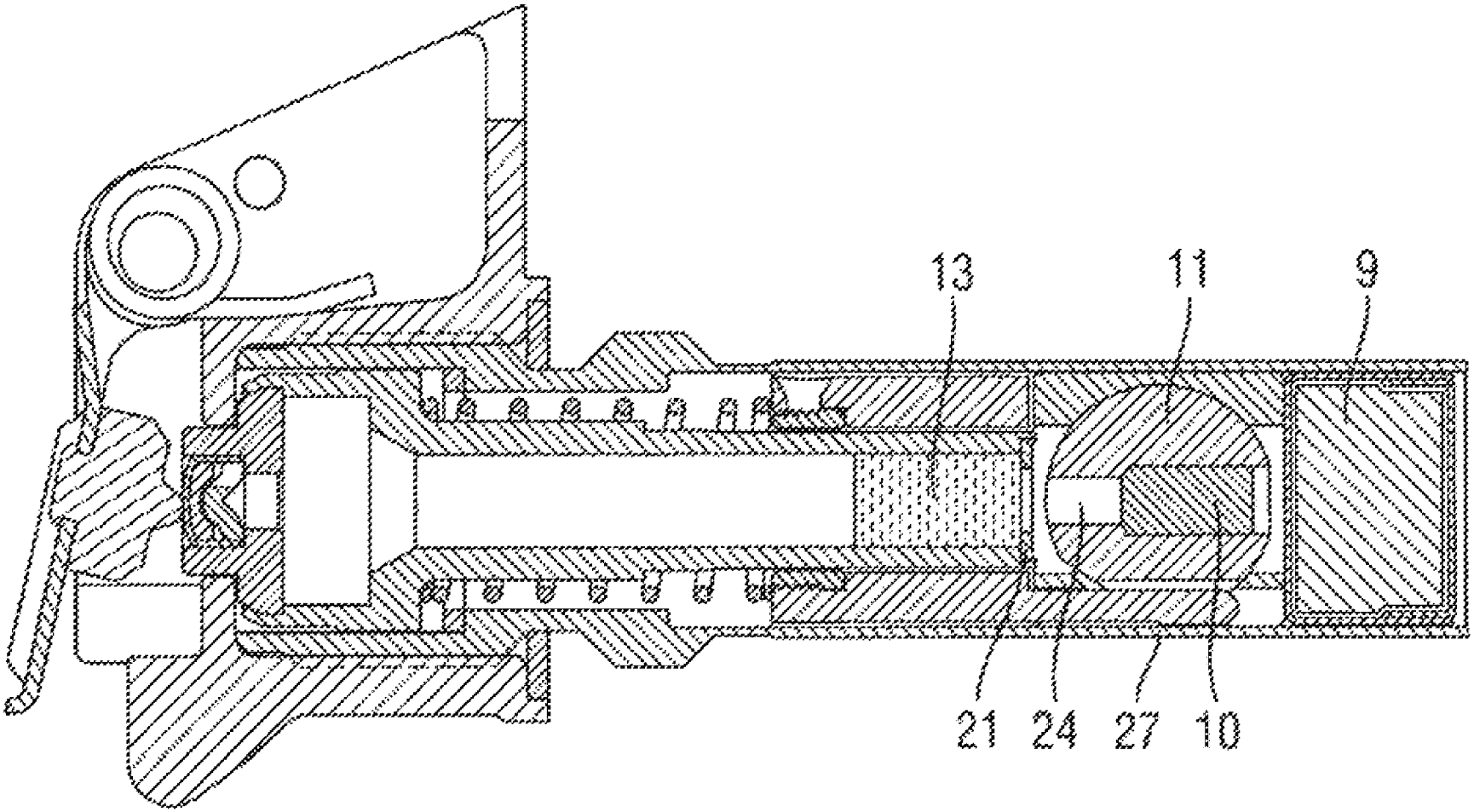
FIG. 5 is a diagrammatic, perspective view of the hand grenade fuze according to the invention having a detonator holder, which has been pivoted to an activation position, shortly before the latter is fired by the delay charge.

FIG. 5 shows the situation at the end of the burning away of the delay charge 13 shortly before the firing of the detonator 10 in the detonator holder 11, which has in the meantime been pivoted to the activation position. Further burning away of the delay charge results in the creation of a firing jet, which fires the detonator through the aperture in the supporting disc 21 and the channel 24. The firing of the detonator results in the firing of the booster charge, which in turn fires the hand grenade explosive charge, which is not shown here.

If the firing cap 16 is not fired correctly, this does not lead to firing of the booster charge, and therefore also does not lead to firing of the hand grenade explosive charge. The firing sequence described above is thus interfered with in this case in that, when the firing sequence is not correct, the grip 6 with the fuze holder 25 is still in its original position in the situation illustrated in FIG. 2, thus preventing the delay charge holder 12 from changing its position. The supporting disc 21 is thus held on the flat 26 on the detonator holder 11, preventing the detonator holder from pivoting to an active position. This is also the case if the solder point 20 is unsoldered by firing of the firing cap 16 and of the delay charge 13. No flame jet originating from the delay charge 13 reaches the detonator. The flame jet is passed into a sleeve 27 which surrounds the hand grenade fuze. If the detonator were nevertheless to be fired after some time because of the heat developed, the energy released during the detonation is likewise bypassed into the sleeve, and therefore does not reach the booster charge 9.

Furthermore, the safety of the hand grenade fuze according to the invention is improved in that the detonator 10 cannot be fired directly by the firing cap 16 when there is no delay charge 13 present or the delay charge 13 is faulty, because the detonator holder 11 is not pivoted to the activation position, because the threaded ring 14 is not unsoldered, as a result of the lack of the delay charge 13. The flame jet from the firing cap 16 is simply passed into the sleeve 27. This is important in order that the hand grenade is not fired immediately, that is to say without any delay, if there is no delay charge 13 or the delay charge 13 is faulty.

The invention claimed is:

1. A hand grenade fuze, comprising:

a firing cap;

a delay charge holder;

a delay charge which can be fired by said firing cap and disposed in said delay charge holder;

a detonator holder;

a detonator which can be fired by said delay charge, said detonator disposed in said detonator holder;

a booster charge which can be fired by said detonator, for firing a hand grenade explosive charge;

said detonator holder configured such that said detonator holder can pivot, and said delay charge holder, when disposed in a first position, blocks a pivoting movement of said detonator holder in a rest position, in which said detonator is not disposed in line with said booster charge and said delay charge, such that burning of said delay charge cannot fire said detonator, and detonation of said detonator cannot fire said booster charge; and said delay charge holder is held in the first position by a connection which can be released by heat, wherein the connection which can be released by heat is disposed such that burning of said delay charge results in the connection which can be released by heat being released and, under an influence of a force action, results in said delay charge holder assuming a second position, with a blocking of the pivoting movement of said detonator holder being cancelled, thus resulting in said detonator holder being pivoted from the rest position to an activation position, as a result of which said detonator is disposed in line with said booster charge and said delay charge, in that said detonator is fired by a burning of said delay charge, and a detonation of said detonator fires said booster charge.

2. The hand grenade fuze according to claim 1, further comprising a slide, said delay charge holder is held together with said slide, which is also provided, in the first position by the connection which can be released by heat, wherein said slide is disposed such that a release of the connection which can be released by heat results, under the influence of the force action, in said slide assuming a third position, wherein, as a result of the third position being assumed, said slide causing said detonator holder to pivot from the rest position to the activation position.

3. The hand grenade fuze according to claim 1, wherein said detonator holder is generally spherical in shape.

4. The hand grenade fuze according to claim 1, wherein said detonator holder has an opening formed therein through which said detonator can be fired by said burning delay charge.

5. The hand grenade fuze according to claim 4, wherein said opening has a form of a channel.

6. The hand grenade fuze according to claim 1, further comprising a supporting disc, which has an aperture formed therein, and is disposed on said delay charge holder between said detonator holder and said delay charge holder, said detonator holder has a flat area on which said supporting disc is held by said delay charge holder, in order to block the pivoting movement.

7. The hand grenade fuze according to claim 1, wherein the connection which can be released by heat is a soldered connection.

8. The hand grenade fuze according to claim 1, further comprising:

a hammer for striking said firing cap;

a safety element; and a secured grip for holding said hammer in an initial position, said delay charge holder being secured in the first position by said secured grip and said safety element being held by said secured grip, said secured grip and said safety element are configured such that removing said safety element and releasing said secured grip result in a safety of said delay charge holder being cancelled.

9. The hand grenade fuze according to claim 8, further comprising a spring; and wherein said hammer is mounted such that said hammer can pivot, and said spring which, when said safety element is removed and said secured grip is released, results in said hammer striking said firing cap in the pivoting movement, and firing said firing cap.

10. The hand grenade fuze according to claim 9, wherein said spring is selected from the group consisting of a stressed torsion spring and a helical leg spring.

11. The hand grenade fuze according to claim 8, wherein at least one of said secured grip, said safety element, and said hand grenade fuze is configured such that removing said safety element and releasing said secured grip result in said secured grip and said safety element being released from said hand grenade fuze.

12. The hand grenade fuze according to claim 1, further comprising:

a hammer for striking said firing cap; and a secured grip for holding said hammer in an initial position, said delay charge holder being secured in the first position by said secured grip, said secured grip configured such that releasing said secured grip result in a safety of said delay charge holder being cancelled.

13. A hand grenade, comprising:

a hand grenade fuze, containing:

a firing cap;

a delay charge holder;

a delay charge which can be fired by said firing cap and disposed in said delay charge holder;

a detonator holder;

a detonator which can be fired by said delay charge, said detonator disposed in said detonator holder;

a booster charge which can be fired by said detonator, for firing a hand grenade explosive charge;

said detonator holder configured such that said detonator holder can pivot, and said delay charge holder, when disposed in a first position, blocks a pivoting movement of said detonator holder in a rest position, in which said detonator is not disposed in line with said booster charge and said delay charge, such that burning of said delay charge cannot fire said detonator, and detonation of said detonator cannot fire said booster charge; and said delay charge holder is held in the first position by a connection which can be released by heat, wherein the connection which can be released by heat is disposed such that burning of said delay charge results in the connection which can be released by heat being released and, under an influence of a force action, results in said delay charge holder assuming a second position, with the blocking of the pivoting movement of said detonator holder being cancelled, thus resulting in the detonator holder being pivoted from the rest position to an activation position, as a result of which said detonator is disposed in line with said booster charge and said delay charge, in that said detonator is fired by the burning of said delay charge, and a detonation of said detonator fires said booster charge.

* * * * *